US008866405B2

(12) United States Patent
Umezawa et al.

(10) Patent No.: US 8,866,405 B2
(45) Date of Patent: Oct. 21, 2014

(54) DISCHARGE-LAMP LIGHTING DEVICE

(75) Inventors: Yoshihisa Umezawa, Konosu (JP); Kensuke Kaneko, Konosu (JP); Tomokazu Osato, Konosu (JP)

(73) Assignee: Eye Lighting Systems Corporation, Tokyo (JP)

( * ) Notice: Subject to any disclaimer, the term of this patent is extended or adjusted under 35 U.S.C. 154(b) by 139 days.

(21) Appl. No.: 13/593,547

(22) Filed: Aug. 24, 2012

(65) Prior Publication Data

US 2013/0049625 A1 Feb. 28, 2013

(30) Foreign Application Priority Data

Aug. 25, 2011 (JP) ..... 2011-183370

(51) Int. Cl.
*H05B 37/02* (2006.01)
*H05B 41/285* (2006.01)

(52) U.S. Cl.
CPC ..... *H05B 41/2858* (2013.01)
USPC ..... 315/291; 315/307; 315/308; 315/224

(58) Field of Classification Search
CPC .... H05B 37/00; H05B 37/02; H05B 41/2853; H05B 41/2858
USPC ..... 315/209 R–211, 224–226, 291, 307, 315/308, 312
See application file for complete search history.

(56) References Cited

U.S. PATENT DOCUMENTS 7,291,990 B2 * 11/2007 Ichikawa et al. ..... 315/291

FOREIGN PATENT DOCUMENTS

JP 2003-100488 4/2003

OTHER PUBLICATIONS

U.S. Appl. No. 13/593,547, Aug. 2012, Umezawa.*
Patent Abstracts of Japan, 2003-100488, ten pages, Apr. 4, 2003.

* cited by examiner

*Primary Examiner* — Jimmy Vu
(74) *Attorney, Agent, or Firm* — Rankin, Hill & Clark LLP

(57) ABSTRACT

A lighting device has a direct-current power generation circuit, a rectangular-wave generation circuit, a pulse generating circuit, lamp-voltage detection means, and pulse-generation command means. The direct-current power generation circuit generates direct-current power from external power. The rectangular-wave generation circuit converts the direct-current power to rectangular-wave alternating-current power. The pulse generating circuit superposes high-voltage pulses on the rectangular-wave power output from the rectangular-wave generation circuit and starts a discharge lamp. The lamp-voltage detection means detects, in digital form, a lamp voltage supplied to the discharge lamp. The pulse-generation command means issues a pulse generation command to the pulse generating circuit when the value detected by the lamp-voltage detection means reaches a predetermined no-load-voltage determination level.

5 Claims, 3 Drawing Sheets

DISCHARGE-LAMP LIGHTING DEVICE

CROSS-REFERENCE TO RELATED APPLICATIONS

This application is based on and claims the benefits of priority from Japanese Patent Application No. 2011-183370, filed on Aug. 25, 2011, the entire contents of which are incorporated herein by reference.

BACKGROUND OF THE INVENTION

1. Field of the Invention

The present invention relates to an improvement of a control circuit that instructs a pulse generating circuit used in a discharge-lamp lighting device to generate pulses.

2. Description of the Related Art

Discharge lamps require lighting devices also called electronic ballasts. The lighting devices generate high-voltage pulses to start an electric discharge, that is, dielectric breakdown between electrodes of the discharge lamps when starting the discharge lamps, and also prevent excessive electric current from passing through caused by a drastic decrease in the voltage between the electrodes (lamp voltage) after the discharge lamps are turned on.

In addition to the above described roles of the lighting devices, to prevent the discharge lamps from flickering, high-frequency lighting and rectangular-wave lighting have been widely used in recent years. To implement these types of lighting, electronic discharge-lamp lighting devices in which a step-down chopper circuit and a bridge circuit are formed by using semiconductor elements to generate the desired high-frequency or rectangular-wave signals have been often used.

To start a discharge lamp, a lamp-voltage detection section first detects the lamp voltage; and, when it is determined that the lamp voltage is at a no-load level, a microcomputer instructs a pulse generating circuit to generate high-voltage pulses. Japanese Unexamined Patent Application Publication No. 2003-100488 describes a discharge-lamp lighting device in which the voltage and current of an electric power converter are detected, a trigger signal is input to a transistor of a high-voltage generating circuit formed of a transformer and the transistor, and an starting high voltage is applied to the lamp.

FIG. 3 shows an example of a conventional discharge-lamp lighting device. This lighting device includes a power-factor correction circuit 14, a step-down chopper circuit 16, a full-bridge circuit 18, and a pulse generating circuit 20. The lighting device also includes a control circuit 124 that operates with a DC voltage supplied from a control power supply circuit 26. A lamp-voltage detection section 132 provided for the control circuit 124 detects an analog value of the lamp voltage and gives the value to a pulse-generation command section 134. A lamp voltage sufficiently lower than a no-load voltage is detected during stable lamp operation. If a lamp 22 goes out during stable operation, the detected lamp voltage increases up to the no-load voltage. The pulse-generation command section 134 determines, according to the detected value of the lamp voltage, whether the lamp is in a no-load state (going out of lamp), and if it is in a no-load state, the pulse-generation command section 134 issues a command to the pulse generating circuit 20 to generate pulses. Restarting the lamp is performed in this manner when the lamp voltage at a no-load state is detected.

After the lamp is turned on correctly, the lamp voltage levels off at a level sufficiently lower than the no-load voltage when the lamp has been used for a short time. If the lamp has been used close to the end of its life, however, the lamp voltage goes high during stable lamp operation and approaches the no-load voltage. Therefore, the analog lamp voltage detector may erroneously detect the no-load voltage even during stable lamp operation if the lamp voltage merely becomes close to the no-load voltage, causing the generation of unwanted starting pulses. This may lead to lamp flickering or lamp malfunctioning.

SUMMARY OF THE INVENTION

The present invention has been made in consideration of the above described related art. An object of the present invention is to provide a highly reliable discharge-lamp lighting device in which pulses are prevented from being generated during stable lamp operation, and with which the life of the lamp used is extended.

To achieve the foregoing object, a discharge-lamp lighting device of the present invention includes a direct-current power generation circuit that generates direct-current power from external power; a rectangular-wave generation circuit that converts the direct-current power to rectangular-wave alternating-current power; a pulse generating circuit that superposes high-voltage pulses on the rectangular-wave power output from the rectangular-wave generation circuit and starts a discharge lamp; lamp-voltage detection means for detecting, in digital form, a lamp voltage supplied to the discharge lamp; and pulse-generation command means for issuing a pulse generation command to the pulse generating circuit when the value detected by the lamp-voltage detection means reaches a predetermined no-load-voltage determination level.

It is preferred that the discharge-lamp lighting device further include input-voltage detection means for detecting the input voltage of the direct-current power generation circuit in digital form, and input-voltage judging means for giving the detection signal of the input voltage to the pulse-generation command means according to the value detected by the input-voltage detection means; and that the pulse-generation command means issue the pulse generation command when the detected value of the lamp voltage reaches the no-load-voltage determination level and when the detection signal of the input voltage is received.

It is preferred that the discharge-lamp lighting device further include lamp-voltage storage means for storing at least one past detected value of the lamp voltage obtained within a predetermined period of time, and that the pulse-generation command means issue the pulse generation command when an increase in the lamp voltage based on the detected value of the lamp voltage and the past detected value in the lamp voltage storage means is equal to or larger than a criterion.

It is preferred that the pulse-generation command means issue the pulse generation command when the increase in the lamp voltage is equal to or larger than the criterion, and then the increased lamp-voltage level is maintained for a predetermined period of time or longer.

As described above, since the present invention detects the lamp voltage at high resolution by using the lamp-voltage detection section that can provide digital detection, a situation where the lamp voltage reaches the no-load voltage is prevented from being erroneously detected. As a result, when a lamp which is close to its end-of-life is stably operating, merely a state in which the detected value of the lamp voltage increases to a value close to the no-load voltage or the detected value reaches the no-load voltage does not lead to erroneous detection of a no-load state, that is, a state in which the lamp goes out during stable operation.

In addition, when a lamp which is close to its end-of-life goes out during stable operation, this state can be correctly detected by using the history of obtained digital data and an attempt can be made to turn on the lamp again by issuing a pulse generation command. More specifically, since a drastic decrease in the lamp voltage after the lamp is turned on correctly and a gradual increase thereafter are recorded as the history in the form of digital data, a drastic increase in the lamp voltage caused by the lamp going out can be clearly distinguished from a gradual increase after the lamp is turned on correctly, making it possible to correctly detect the lamp going out.

Therefore, according to the present invention, a highly reliable discharge-lamp lighting device can be provided in which pulses are prevented from being generated during stable lamp operation, and with which the life of the lamp used is extended.

DESCRIPTION OF THE PREFERRED EMBODIMENTS

Figure 1:
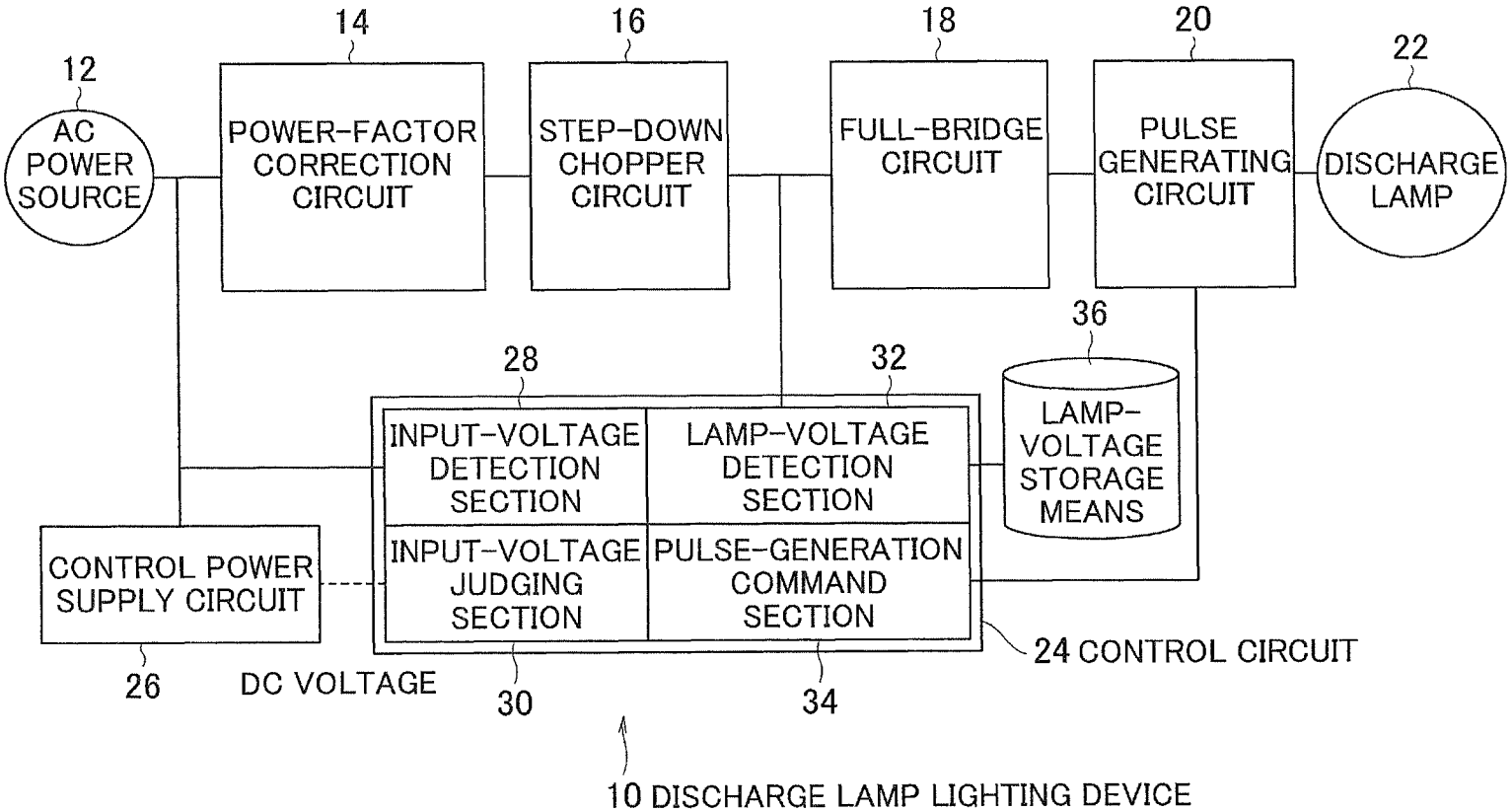
FIG. 1 is a view showing the entire configuration of a discharge-lamp lighting device of the present invention.

A preferred embodiment of the present invention will be described below with reference to the drawings. FIG. 1 shows an outlined structure of a discharge-lamp lighting device 10 of the present invention.

The discharge-lamp lighting device (also simply called an electronic ballast) 10 includes a power-factor correction circuit 14 that sufficiently boosts the alternating current of a commercial alternating-current power source 12, that controls an output direct-current voltage to a constant level, and that reduces the harmonics of the input current; a step-down chopper circuit 16 that controls the current with pulse width modulation; a full-bridge circuit 18 that converts direct-current lighting power output from the step-down chopper circuit 16 to rectangular-wave alternating-current power with switching elements configured in a full bridge, and a pulse generating circuit 20 that generates starting pulses.

Circuit configurations of the power-factor correction circuit 14 and the step-down chopper circuit 16 are not limited to any specific configurations. For example, the power-factor correction circuit 14 includes a booster transformer, a switching element, a diode, an output capacitor, and a driver for the switching element. When the driver controls the operation of the switching element, a constant boosted direct-current voltage is generated between the terminals of the output capacitor.

For example, the step-down chopper circuit 16 includes a switching element for controlling an average current with pulse width modulation, a choke coil for smoothing the modulated current, a diode, an output capacitor, and a driver for the switching element. The driver may control the operation of the switching element.

The full-bridge circuit 18 includes the bridge-connected switching elements and a driver for controlling the switching elements on and off, and outputs high-frequency rectangular-wave lighting power.

The lighting device may be a discharge-lamp lighting device that uses a full-bridge step-down chopper circuit or a half-bridge step-down chopper circuit, both of which have the function of the step-down chopper circuit 16 and the function of the full-bridge circuit 18. To drive the switching elements, analog control ICs may be used instead of the drivers.

The pulse generating circuit 20 uses pulse transformers. The pulse generating circuit 20 includes a primary transformer and a transistor connected in parallel with a lamp 22 and a secondary transformer connected in series to the lamp 22. In this circuit, a pulse generation command sent from a microcomputer serves as a trigger signal for a triac, and starting pulses are generated. The starting pulses are superposed on the output of the full-bridge circuit 18 and applied to the lamp 22.

The configuration of the pulse generating circuit 20 is not limited to that described above. At the minimum requirement, the pulse generating circuit 20 needs to generate the starting pulses when an external generation command is given.

The discharge-lamp lighting device 10 also includes a control circuit 24 that uses the microcomputer. The microcomputer sends on and off timing signals to the driver for each switching element. For this purpose, the control circuit 24 includes an AD converter that detects a lamp voltage in digital form, and the microcomputer uses the detected value of the lamp voltage to calculate and output the timing signals to each driver. In this way, the microcomputer specifies a current value, a voltage value, and a rectangular-wave frequency all appropriate for the connected lamp 22.

The discharge-lamp lighting device 10 is also provided with a control power supply circuit 26 that supplies a driving voltage to each driver. A part of the voltage input to the power-factor correction circuit 14 is supplied to the control power supply circuit 26 and is converted (with a DC-DC converter) to a predetermined driving voltage in the control power supply circuit 26. Then, the driving voltage is supplied to each driver.

According to the timing signals, the driver for each switching element applies the driving voltage that is turned on and off at that timing to the gate of the switching element.

The control circuit 24 is further provided with an input-voltage detection section 28 that detects the voltage input to the power-factor correction circuit 14; an input-voltage judging section 30 that judges whether the input voltage is applied; a lamp-voltage detection section 32 that detects the lamp voltage; and a pulse-generation command section 34 that issues a pulse generation command according to the detected value of the lamp voltage, which are features of the present invention.

The input-voltage detection section 28 includes an AD converter that detects the voltage input to the control power supply circuit 26. The input-voltage judging section 30 monitors the detected value of the input voltage, and when it detects an input voltage equal to or larger than a predetermined value, it gives a detection signal to the pulse-generation command section 34.

The lamp-voltage detection section 32 includes the AD converter that detects, as the lamp voltage, the direct-current output voltage of the step-down chopper circuit 16, which is the preceding stage of the full-bridge circuit 18. The pulse-generation command section 34 monitors the detected value of the lamp voltage, and when it is determined that the lamp voltage is equal to or higher than a no-load voltage, the pulse-generation command section 34 issues a pulse generation command to the pulse generating circuit 20. The pulse-generation command section 34 is programmed so as to issue the pulse generation command only when the detection signal is received from the input-voltage judging section 30. The control circuit 24 can use the digital value detected in the lamp-voltage detection section 32 to calculate timing signals sent to each driver.

Lamp voltage changes that take place when the discharge lamp is turned on correctly will be described below with reference to FIG. 2.

Generation of Starting Pulses Caused when the No-Load Voltage is Detected

After the alternating-current power source 12 is turned on, when the voltage input to the power-factor correction circuit 14 reaches a predetermined value or more, the input-voltage judging section 30 gives the input-voltage detection signal to the pulse-generation command section 34 according to the value detected in the input-voltage detection section 28. As the alternating-current power source 12 is turned on, the power-factor correction circuit 14, the step-down chopper circuit 16, and the full-bridge circuit 18 start up sequentially, and the output voltage of the full-bridge circuit 18 exceeds a no-load-voltage determination level. In the present embodiment, the no-load voltage is about 240 V, but generally it is 200 V or higher. The no-load-voltage determination level is set between 240 V and 325 V, both inclusive, for a lamp voltage of 90 V at an initial usage stage, for example. This setting range is just an example, and the no-load-voltage determination level differs from lamp to lamp. This is because the lamp voltage may be 90 V, 130 V, or 250 V, for example, and the no-load-voltage determination level is set according to the lamp voltage.

When the output voltage exceeds this determination level, a lamp voltage equal to or higher than the no-load voltage is detected according to the value detected in the lamp-voltage detection section 32, and the pulse-generation command section 34 sends a pulse generation command to the pulse generating circuit 20. The no-load voltage on which high-voltage pulses are superposed is applied to the lamp 22 to turn on the lamp 22. When the lamp 22 is turned on, the lamp voltage drastically decreases, and the pulse generation is stopped.

Lamp-on Detection and Stable Lamp Operation

The lamp-voltage detection section 32 constantly detects the lamp voltage during a start-up period. Immediately after the lamp is turned on, a drastic decrease in the lamp voltage is detected to determine that the lamp was turned on. This voltage decrease is usually 20 V or less. Then, the lamp voltage starts to increase. When the lamp enters stable operation, the lamp voltage increases gradually. When the lamp has been used for a short time, after the lamp voltage increases gradually, the lamp voltage levels off at 70 V or more, in the present invention, at 110 V or less. The voltage at which the lamp voltage levels off differs from lamp to lamp.

Figure 2:
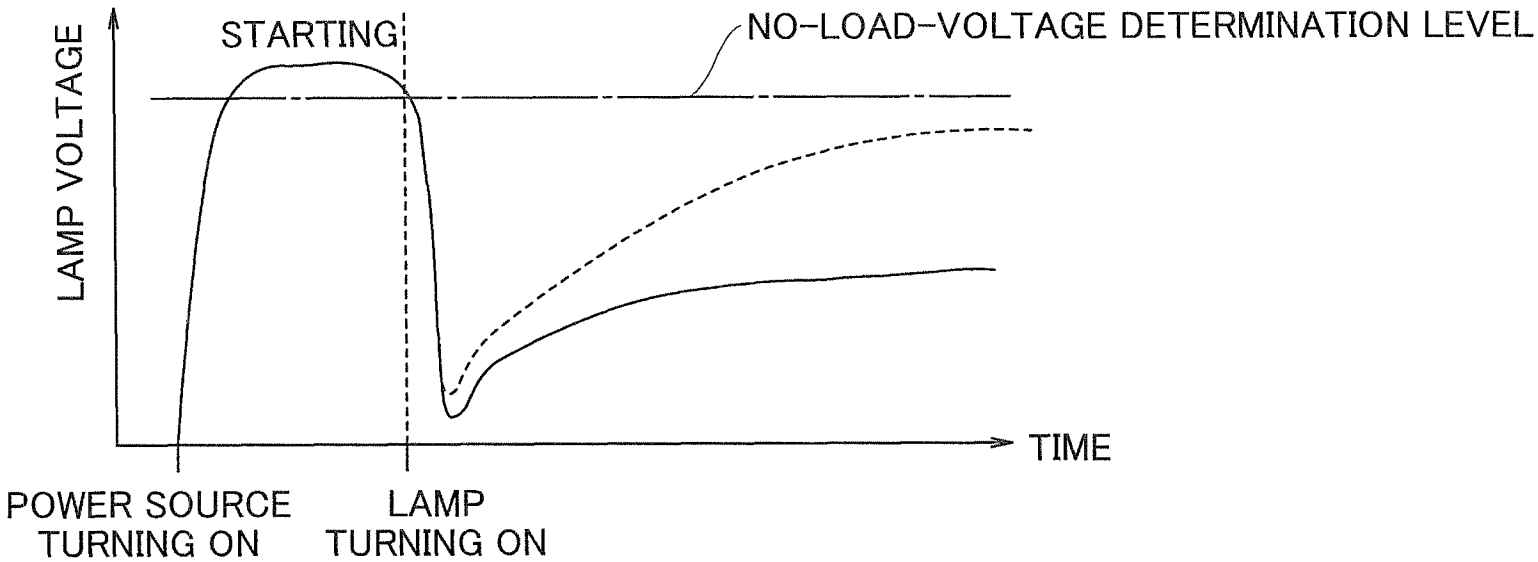
FIG. 2 is a graph showing changes in lamp voltage in the discharge-lamp lighting device.
Figure 3:
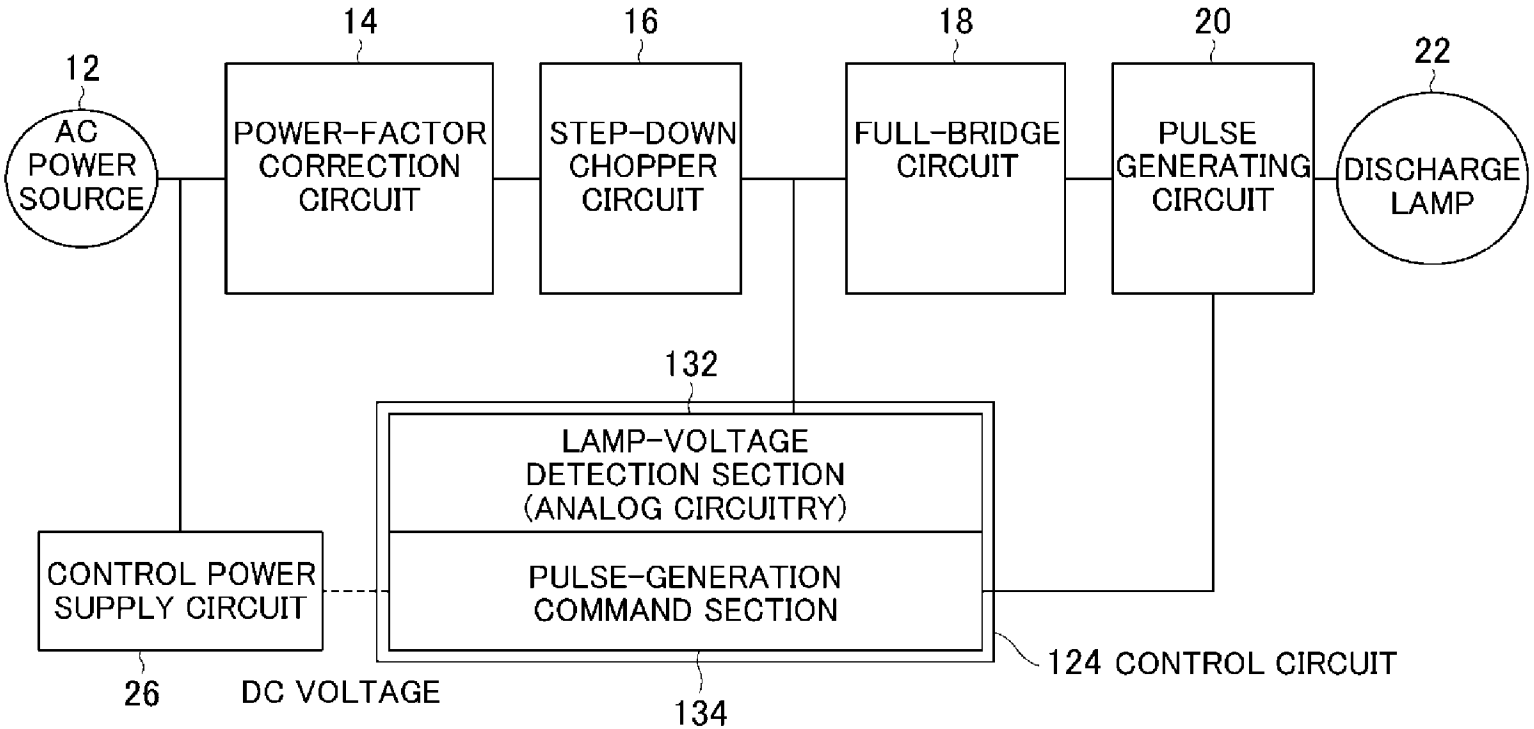
FIG. 3 PRIOR ART
FIG. 3 is a view showing the entire structure of a conventional discharge-lamp lighting device.

Such temporal changes in the lamp voltage are a particular characteristic of discharge lamps, as shown in FIG. 2. With such a particular characteristic taken into consideration, usual lighting devices protect the discharge lamps by appropriately detecting erroneous lamp operation and by interrupting the output voltage, if necessary.

Lamp Going Out and Restarting Lamp

A case will be described in which the lamp 22 goes out during a start up period or in stable operation. Since the lamp-voltage detection section 32 detects a lamp voltage that has increased to the no-load-voltage determination level or higher because the lamp goes out, the pulse-generation command section 34 issues a pulse generation command, and the pulse generating circuit 20 restarts the lamp 22. With this, the lamp 22 is turned on again within a short period after it goes out.

Turning on Lamp that has been Used for a Long Time

When the lamp is turned on correctly, if the lamp has been used for a short time, the lamp voltage levels off at a level sufficiently lower than the no-load voltage. If the lamp has been used for a long time, however, the lamp voltage during stable operation becomes high and approaches the no-load voltage. This change is indicated by a dashed curve in FIG. 2. Because of this phenomenon, the conventional analog lamp-voltage detector erroneously detects the no-load voltage irrespective of the stable operation of the lamp if the lamp voltage merely approaches the no-load voltage, causing unwanted starting pulses to be generated in some cases.

In the present invention, since the lamp voltage is detected in digital form by the use of the AD converter, even when the lamp voltage approaches the no-load voltage because the lamp is close to its end-of-life, if the lamp voltage does not reach the no-load-voltage determination level, the lamp voltage is prevented from being erroneously detected as the no-load voltage, preventing unwanted starting pulses from being generated.

In addition, when the lamp has been used for a long time and is in stable operation, even if the lamp voltage reaches the no-load-voltage determination level, this situation can be distinguished from the no-load voltage caused when the lamp goes out, and the stable operation can be maintained. It is possible to correctly detect the lamp going out during stable operation. These are features of the present invention.

For example, when the no-load-voltage determination level is set in the range from 240 V to 325 V, if the lamp is close to its end-of-life and is in stable operation, the lamp voltage can reach this determination level. The determination made based on the conventional analog detection cannot distinguish between a state in which the lamp voltage reaches the determination level because the lamp goes out and a state in which the lamp voltage reaches the determination level in stable operation because the lamp is close to its end-of-life. When the lamp voltage reaches the determination level in stable operation because the lamp is close to its end-of-life, the lamp voltage rises gradually to the determination level, as shown in FIG. 2. In contrast, when the lamp goes out, the lamp voltage rises drastically to reach the determination level. Therefore, when the temporal changes (voltage changes) of the lamp voltage after the lamp is turned on are monitored, a state in which the lamp enters a no-load state because it goes out can be correctly distinguished from continuous stable operation.

In the present invention, since the lamp voltage is detected in digital form, the detected value of the lamp voltage can be obtained at high resolution, and the history of the lamp voltage can be used as a reference for determining the lamp state. For example, when the lamp voltage increases drastically within a very short period and reaches the determination level, it is determined that the lamp is in a no-load state. When the lamp voltage reaches the determination level without a drastic increase, it is considered that the lamp continues stable operation, and it is not determined that the lamp is in a no-load state. The state of the lamp operation can be monitored with such determinations.

In the present invention, lamp-voltage storage means 36 is provided for storing at least one past detected voltage value obtained within a predetermined period of time (about one second). The pulse-generation command section 34 determines that the lamp voltage reaches the no-load voltage when an increase in the lamp voltage per unit time is 20 V/ms or more, for example. The pulse-generation command section 34 may determine that the lamp voltage reaches the no-load voltage when the lamp voltage increases drastically and then maintains that level for 20 ms or more, for example, to avoid the detection of noise. The criteria for the increase in the lamp voltage per unit time and the predetermined period of time when the voltage level is maintained are set to appropriate values depending on the type of lamp used, such as the initial lamp voltage at the start of use.

Since the AD converter is used in the lamp-voltage detection section 32 to allow the lamp voltage to be detected at high resolution in the discharge-lamp lighting device 10 of the present invention, as described above, a situation where the lamp voltage reaches the no-load voltage can be prevented from being erroneously detected. As a result, erroneous detection of the no-load state (going out of lamp), which would be made just because the detected value of the lamp voltage increases to a value close to the no-load voltage or reaches the no-load voltage irrespective of the stable operation of a lamp which is close to its end-of-life, is eliminated.

In addition, if a lamp which is close to its end-of-life goes out during stable operation, the history of acquired digital data can be used to find that the lamp went out, and an attempt can be made to turn on the lamp again by issuing a pulse generation command. More specifically, since the history of digital data has recorded an event in which the lamp voltage decreases drastically after the lamp is correctly turned on, followed by a gradual increase in the lamp voltage, a drastic increase in the lamp voltage caused by the lamp going out can be clearly distinguished from a gradual increase in the lamp voltage in stable operation, and it is possible to correctly detect the lamp going out.

Therefore, according to the present invention, a highly reliable discharge-lamp lighting device can be provided in which pulses are prevented from being generated during stable lamp operation, and with which the life of the lamp used is extended.

| Description of Reference Signs | |
|---|---|
| 12 | AC power source |
| 14 | power-factor correction circuit |
| 16 | step-down chopper circuit |
| 18 | full-bridge circuit |
| 20 | pulse generating circuit |
| 22 | discharge lamp |
| 24 | control circuit |
| 26 | control power supply circuit |
| 28 | input-voltage detection section |
| 30 | input-voltage judging section |
| 32 | lamp-voltage detection section |
| 34 | pulse-generation command section |

What is claimed is:

1. A discharge-lamp lighting device comprising:

a direct-current power generation circuit that generates direct-current power from external power, a rectangular-wave generation circuit that converts the direct-current power to rectangular-wave alternating-current power, a pulse generating circuit that superposes high-voltage pulses on the rectangular-wave power output from the rectangular-wave generation circuit and starts a discharge lamp, lamp-voltage detection means for detecting, in digital form, a lamp voltage supplied to the discharge lamp, and pulse-generation command means for issuing a pulse generation command to the pulse generating circuit when the value detected by the lamp-voltage detection means reaches a predetermined no-load-voltage determination level, input-voltage detection means for detecting the input voltage of the direct-current power generation circuit in digital form, and input-voltage judging means for giving the detection signal of the input voltage to the pulse-generation command means according to the value detected by the input-voltage detection means, and wherein the pulse-generation command means issue the pulse generation command when the detected value of the lamp voltage reaches the no-load-voltage determination level and when the detection signal of the input voltage is received.

2. The lighting device according to claim 1, further including:

lamp-voltage storage means for storing at least one past detected value of the lamp voltage obtained within a predetermined period of time, and wherein the pulse-generation command means issue the pulse generation command when an increase in the lamp voltage based on the detected value of the lamp voltage and the past detected value in the lamp voltage storage means is equal to or larger than a criterion.

3. A The lighting device according to claim 2, wherein the pulse-generation command means issue the pulse generation command when the increase in the lamp voltage is equal to or larger than the criterion, and then the increased lamp-voltage level is maintained for a predetermined period of time or longer.

4. A discharge-lamp lighting device comprising:

a direct-current power generation circuit that generates direct-current power from external power, a rectangular-wave generation circuit that converts the direct-current power to rectangular-wave alternating-current power, a pulse generating circuit that superposes high-voltage pulses on the rectangular-wave power output from the rectangular-wave generation circuit and starts a discharge lamp, lamp-voltage detection means for detecting, in digital form, a lamp voltage supplied to the discharge lamp, and pulse-generation command means for issuing a pulse generation command to the pulse generating circuit when the value detected by the lamp-voltage detection means reaches a predetermined no-load-voltage determination level, a lamp-voltage storage means for storing at least one past detected value of the lamp voltage obtained within a predetermined period of time, and wherein the pulse-generation command means issue the pulse generation command when an increase in the lamp voltage based on the detected value of the lamp voltage and the past detected value in the lamp voltage storage means is equal to or larger than a criterion.

5. The lighting device according to claim 4, wherein the pulse-generation command means issue the pulse generation command when the increase in the lamp voltage is equal to or larger than the criterion, and then the increased lamp-voltage level is maintained for a predetermined period of time or longer.

* * * * *

UNITED STATES PATENT AND TRADEMARK OFFICE

CERTIFICATE OF CORRECTION

PATENT NO. : 8,866,405 B2
APPLICATION NO. : 13/593547
DATED : October 21, 2014
INVENTOR(S) : Yoshihisa Umezawa et al.

It is certified that error appears in the above-identified patent and that said Letters Patent is hereby corrected as shown below:

In the claims,

Column 8, Line 26, (Claim 3), delete "A" before "The".

Signed and Sealed this
Twenty-first Day of April, 2015

Michelle K. Lee

Michelle K. Lee
*Director of the United States Patent and Trademark Office*